US009989057B2

(12) United States Patent
Lochner et al.

(10) Patent No.: US 9,989,057 B2
(45) Date of Patent: Jun. 5, 2018

(54) VARIABLE VOLUME RATIO SCROLL COMPRESSOR

(71) Applicant: Emerson Climate Technologies, Inc., Sidney, OH (US)

(72) Inventors: Jason P. Lochner, Union, OH (US); Keith A. Brown, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 386 days.

(21) Appl. No.: 14/294,458

(22) Filed: Jun. 3, 2014

(65) Prior Publication Data

US 2015/0345493 A1 Dec. 3, 2015

(51) Int. Cl.
*F01C 1/063* (2006.01)
*F04C 2/00* (2006.01)
(Continued)

(52) U.S. Cl.
CPC ..... *F04C 23/008* (2013.01); *F04C 18/0215* (2013.01); *F04C 28/16* (2013.01); *F04C 29/128* (2013.01)

(58) Field of Classification Search
CPC ..... F04C 18/0223; F04C 28/18; F04C 29/12; F04C 18/0207; F04C 18/0215;
(Continued)

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1137614 A 12/1996
CN 1158944 A 9/1997
(Continued)

OTHER PUBLICATIONS

Advisory Action regarding U.S. Appl. No. 14/073,293, dated Apr. 18, 2016.
(Continued)

*Primary Examiner* — Mark Laurenzi
*Assistant Examiner* — Anthony Ayala Delgado
(74) *Attorney, Agent, or Firm* — Harness, Dickey & Pierce, P.L.C.

(57) ABSTRACT

A compressor may include a scroll member, a hub, a discharge valve and a bypass valve. An end plate of the scroll member includes a recess, a discharge passage in communication with the recess, and a bypass passage in communication with the recess and disposed radially outward relative to the discharge passage. The hub may be received in the recess and may include a central opening in communication with the discharge passage and the bypass passage. The discharge valve may be disposed between the hub and the end plate and may control fluid flow through the discharge passage. The bypass valve may be disposed between the hub and the end plate and may be movable between a first position restricting fluid flow through the bypass passage and a second position allowing fluid to flow through the bypass passage, around the discharge valve and through the central opening.

29 Claims, 6 Drawing Sheets

(51) Int. Cl.

| | |
|---|---|
| ***F04C 23/00*** | (2006.01) |
| ***F04C 28/16*** | (2006.01) |
| ***F04C 29/12*** | (2006.01) |
| ***F04C 18/02*** | (2006.01) |

(58) Field of Classification Search
CPC ..... F04C 18/0253; F04C 18/0292; F04C 23/008; F04C 28/12; F04C 29/124
USPC ..... 418/55.1, 55.5, 57, 15
See application file for complete search history.

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,475,360 A 10/1984 Suefuji et al.
4,497,615 A 2/1985 Griffith
4,545,742 A 10/1985 Schaefer
4,580,949 A 4/1986 Maruyama et al.
4,609,329 A 9/1986 Pillis et al.
4,696,630 A 9/1987 Sakata et al.
4,727,725 A 3/1988 Nagata et al.
4,774,816 A 10/1988 Uchikawa et al.
4,818,195 A 4/1989 Murayama et al.
4,846,633 A 7/1989 Suzuki et al.
4,877,382 A 10/1989 Caillat et al.
4,886,425 A 12/1989 Itahana et al.
4,940,395 A 7/1990 Yamamoto et al.
5,040,952 A 8/1991 Inoue et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
RE34,148 E 12/1992 Terauchi et al.
5,169,294 A 12/1992 Barito
5,192,195 A 3/1993 Iio et al.
5,193,987 A 3/1993 Iio et al.
5,240,389 A 8/1993 Oikawa et al.
5,253,489 A 10/1993 Yoshii
5,356,271 A 10/1994 Miura et al.
5,451,146 A 9/1995 Inagaki et al.
5,482,637 A 1/1996 Rao et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,611,674 A 3/1997 Bass et al.
5,613,841 A 3/1997 Bass et al.
5,639,225 A 6/1997 Matsuda et al.
5,640,854 A 6/1997 Fogt et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,855,475 A 1/1999 Fujio et al.
5,885,063 A 3/1999 Makino et al.
5,993,171 A 11/1999 Higashiyama
5,993,177 A 11/1999 Terauchi et al.
6,047,557 A 4/2000 Pham et al.
6,086,335 A 7/2000 Bass et al.
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,164,940 A 12/2000 Terauchi et al.
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,273,691 B1 8/2001 Morimoto et al.
6,293,767 B1 9/2001 Bass
6,293,776 B1 9/2001 Hahn et al.
6,322,340 B1 11/2001 Itoh et al.
6,350,111 B1 2/2002 Perevozchikov et al.
6,379,123 B1 4/2002 Makino et al.
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,679,683 B2 1/2004 Seibel et al.
6,715,999 B2 4/2004 Ancel et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,893,229 B2 5/2005 Choi et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,547,202 B2 6/2009 Knapke
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,891,961 B2 2/2011 Shimizu et al.
RE42,371 E 5/2011 Peyton
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
8,025,492 B2 9/2011 Seibel et al.
8,308,448 B2 11/2012 Fields et al.
8,328,531 B2 12/2012 Milliff et al.
8,506,271 B2 8/2013 Seibel et al.
8,517,703 B2 * 8/2013 Doepker ..... F04C 18/0215 137/511
8,585,382 B2 11/2013 Akei et al.
8,616,014 B2 12/2013 Stover et al.

(56) References Cited

U.S. PATENT DOCUMENTS

| | | | |
|---|---|---|---|
| 8,790,098 | B2 | 7/2014 | Stover et al. |
| 8,840,384 | B2 | 9/2014 | Patel et al. |
| 8,857,200 | B2 | 10/2014 | Stover et al. |
| 8,932,036 | B2 | 1/2015 | Monnier et al. |
| 9,127,677 | B2 | 9/2015 | Doepker |
| 9,145,891 | B2 | 9/2015 | Kim et al. |
| 9,249,802 | B2 | 2/2016 | Doepker et al. |
| 9,303,642 | B2 | 4/2016 | Akei et al. |
| 9,435,340 | B2 | 9/2016 | Doepker et al. |
| 9,494,157 | B2 | 11/2016 | Doepker |
| 9,605,677 | B2 | 3/2017 | Heidecker et al. |
| 9,651,043 | B2 | 5/2017 | Stover et al. |
| 9,777,730 | B2 | 10/2017 | Doepker et al. |
| 9,790,940 | B2 | 10/2017 | Doepker et al. |
| 9,879,674 | B2 | 1/2018 | Akei et al. |
| 2001/0010800 | A1 | 8/2001 | Kohsokabe et al. |
| 2002/0039540 | A1 | 4/2002 | Kuroki et al. |
| 2003/0044296 | A1 | 3/2003 | Chen |
| 2003/0186060 | A1 | 10/2003 | Rao |
| 2003/0228235 | A1 | 12/2003 | Sowa et al. |
| 2004/0136854 | A1 | 7/2004 | Kimura et al. |
| 2004/0146419 | A1 | 7/2004 | Kawaguchi et al. |
| 2004/0184932 | A1 | 9/2004 | Lifson |
| 2004/0197204 | A1 | 10/2004 | Yamanouchi et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0198748 | A1 | 9/2006 | Grassbaugh et al. |
| 2006/0228243 | A1 | 10/2006 | Sun et al. |
| 2006/0233657 | A1 | 10/2006 | Bonear et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0138227 | A1 | 6/2008 | Knapke |
| 2008/0159892 | A1 | 7/2008 | Huang et al. |
| 2008/0159893 | A1 | 7/2008 | Caillat |
| 2008/0196445 | A1 | 8/2008 | Lifson et al. |
| 2008/0223057 | A1 | 9/2008 | Lifson et al. |
| 2008/0305270 | A1 | 12/2008 | Uhlianuk et al. |
| 2009/0035167 | A1 | 2/2009 | Sun |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2012/0107163 | A1 | 5/2012 | Monnier et al. |
| 2013/0078128 | A1 | 3/2013 | Akei |
| 2013/0121857 | A1 | 5/2013 | Liang et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2015/0192121 | A1 | 7/2015 | Sung et al. |
| 2015/0330386 | A1 | 11/2015 | Doepker |
| 2015/0354719 | A1 | 12/2015 | van Beek et al. |
| 2016/0115954 | A1 | 4/2016 | Doepker et al. |
| 2017/0002817 | A1 | 1/2017 | Stover |
| 2017/0002818 | A1 | 1/2017 | Stover |
| 2017/0030354 | A1 | 2/2017 | Stover |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2018/0038369 | A1 | 2/2018 | Doepker et al. |
| 2018/0038370 | A1 | 2/2018 | Doepker et al. |

FOREIGN PATENT DOCUMENTS

| | | | |
|---|---|---|---|
| CN | 1158945 | A | 9/1997 |
| CN | 1289011 | A | 3/2001 |
| CN | 1349053 | A | 5/2002 |
| CN | 1382912 | A | 12/2002 |
| CN | 1517553 | A | 8/2004 |
| CN | 1680720 | A | 10/2005 |
| CN | 1702328 | A | 11/2005 |
| CN | 2747381 | Y | 12/2005 |
| CN | 1828022 | A | 9/2006 |
| CN | 1963214 | A | 5/2007 |
| CN | 1995756 | A | 7/2007 |
| CN | 101358592 | A | 2/2009 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102422024 | A | 4/2012 |
| CN | 102449314 | A | 5/2012 |
| CN | 102762866 | A | 10/2012 |
| CN | 202926640 | U | 5/2013 |
| CN | 103502644 | A | 1/2014 |
| CN | 204041454 | U | 12/2014 |
| CN | 104838143 | A | 8/2015 |
| CN | 205533207 | U | 8/2016 |
| CN | 205876712 | U | 1/2017 |
| CN | 205876713 | U | 1/2017 |
| CN | 205895597 | U | 1/2017 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| GB | 2107829 | A | 5/1983 |
| JP | 60259794 | | 12/1985 |
| JP | S6385277 | A | 4/1988 |
| JP | 63-205482 | | 8/1988 |
| JP | H0281982 | A | 3/1990 |
| JP | 03081588 | A | 4/1991 |
| JP | H04272490 | A | 9/1992 |
| JP | H07-293456 | A | 11/1995 |
| JP | H08247053 | A | 9/1996 |
| JP | 08334094 | A | 12/1996 |
| JP | H8320079 | A | 12/1996 |
| JP | H09-177689 | A | 7/1997 |
| JP | 11107950 | | 4/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| JP | 2013167215 | A | 8/2013 |
| KR | 1019870000015 | | 5/1985 |
| KR | 870000015 | B1 | 1/1987 |
| KR | 20050027402 | A | 3/2005 |
| KR | 20050095246 | A | 9/2005 |

(56) References Cited

FOREIGN PATENT DOCUMENTS

| | | | |
|---|---|---|---|
| KR | 100547323 | B1 | 1/2006 |
| KR | 20100017008 | A | 2/2010 |
| KR | 101192642 | B1 | 10/2012 |
| WO | WO-0073659 | A1 | 12/2000 |
| WO | WO-2007046810 | A2 | 4/2007 |
| WO | WO-2009017741 | A1 | 2/2009 |
| WO | WO-2009155099 | A2 | 12/2009 |
| WO | WO-2010118140 | A2 | 10/2010 |
| WO | WO-2012114455 | A1 | 8/2012 |

OTHER PUBLICATIONS

First Office Action regarding Chinese Application No. 201380059666.8, dated Apr. 5, 2016. Translation provided by Unitalen Attorneys At Law.
First Office Action regarding Chinese Application No. 201380062614.6, dated Apr. 5, 2016. Translation provided by Unitalen Attorneys At Law.
Interview Summary regarding U.S. Appl. No. 14/060,240, dated Dec. 1, 2015.
Office Action regarding Chinese Patent Application No. 201380059963.2, dated May 10, 2016. Translation provided by Unitalen Attorneys at Law.
Office Action regarding Chinese Patent Application No. 201380062657.4, dated May 4, 2016. Translation provided by Unitalen Attorneys at Law.
Office Action regarding Chinese Patent Application No. 201410460792.0, dated Feb. 25, 2016. Translation provided by Unitalen Attorneys at Law.
Office Action regarding Chinese Patent Application No. 201410461048.2, dated Nov. 30, 2015. Translation provided by Unitalen Attorneys at Law.
Office Action regarding U.S. Appl. No. 14/060,102, dated Jun. 14, 2016.
Office Action regarding U.S. Appl. No. 14/073,293, dated Jan. 29, 2016.
Office Action regarding U.S. Appl. No. 14/073,293, dated Sep. 25, 2015.
Restriction Requirement regarding U.S. Appl. No. 14/060,102, dated Mar. 16, 2016.
Restriction Requirement regarding U.S. Appl. No. 14/060,102, dated Oct. 7, 2015.
Search Report regarding European Patent Application No. 10762374.6-1608 / 2417356 PCT/US2010030248, dated Jun. 16, 2015.
International Search Report regarding Application No. PCT/US2011/025921, dated Oct. 7, 2011.
Written Opinion of the International Search Authority regarding Application No. PCT/US2011/025921, dated Oct. 7, 2011.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 15/646,654, dated Feb. 9, 2018.
Office Action regarding U.S. Appl. No. 15/651,471 dated Feb. 23, 2018.
Office Action regarding Indian Patent Application No. 1907/MUMNP/2012, dated Feb. 26, 2018.
U.S. Appl. No. 15/784,458, filed Oct. 16, 2017, Roy J. Doepker et al.
U.S. Appl. No. 15/784,540, filed Oct. 16, 2017, Roy J. Doepker et al.
U.S. Appl. No. 15/881,016, filed Jan. 26, 2018, Masao Akei et al.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
Office Action regarding U.S. Appl. No. 14/757,407, dated Oct. 13, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys At Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent No. 201580029636.1, dated Jan. 17, 2018. Translation provided by Unitalen Attorneys at Law.
Written Opinion of the International Searching Authority regarding Application No. PCT/US2010/030248, dated Nov. 26, 2010.
International Search Report regarding Application No. PCT/US2010/030248, dated Nov. 26, 2010.
U.S. Office Action regarding U.S. Appl. No. 13/181,065 dated Nov. 9, 2012.
U.S. Office Action regarding U.S. Appl. No. 11/645,288 dated Nov. 30, 2009.
Extended European Search Report regarding Application No. EP07254962 dated Mar. 12, 2008.
First China Office Action regarding Application No. 200710160038.5 dated Jul. 8, 2010. Translation provided by Unitalen Attorneys At Law.
China Office Action regarding Application No. 200710160038.5 dated Jan. 31, 2012. Translation provided by Unitalen Attorneys At Law.
China Office Action regarding Application No. 201080020243.1 dated Nov. 5, 2013. Translation provided by Unitalen Attorneys At Law.
International Search Report regarding Application No. PCT/US2013/051678, dated Oct. 21, 2013.
Written Opinion of the International Searching Authority regarding Application No. PCT/US2013/051678, dated Oct. 21, 2013.
International Search Report regarding Application No. PCT/US2013/069462, dated Feb. 21, 2014.

(56) References Cited

OTHER PUBLICATIONS

Written Opinion of the internation Searching Authority regarding Application No. PCT/US2013/069462, dated Feb. 21, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
Second Office Action regarding China Application No. 201180010366.1 dated Dec. 31, 2014. Translation provided by Unitalen Attorneys At Law.
Office Action regarding U.S. Appl. No. 14/081,390, dated Mar. 27, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.

* cited by examiner

VARIABLE VOLUME RATIO SCROLL COMPRESSOR

FIELD

The present disclosure relates to a variable volume ratio compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a scroll member, a hub, a discharge valve and a bypass valve. The scroll member includes an end plate and a wrap extending from the end plate. The end plate includes a recess, a discharge passage in communication with the recess, and a bypass passage in communication with the recess and disposed radially outward relative to the discharge passage. The hub may be received in the recess and may include a central opening in communication with the discharge passage and the bypass passage. The discharge valve may be disposed between the hub and the end plate and may control fluid flow through the discharge passage. The bypass valve may be disposed between the hub and the end plate and may be movable between a first position restricting fluid flow through the bypass passage and a second position allowing fluid to flow through the bypass passage, around the discharge valve and through the central opening.

In some embodiments, the bypass valve includes a valve retainer engaging a reed valve member and defining the second position of the bypass valve.

In some embodiments, the compressor includes an annular spring disposed between the hub and the valve retainer. The annular spring biases the valve retainer toward the end plate.

In some embodiments, the compressor includes first and second non-threaded pins extending through the valve retainer and a fixed end of the reed valve member and engaging the end plate, wherein a movable end of the reed valve member is deflectable relative to the fixed end between the first and second positions.

In some embodiments, the compressor includes an annular spacer member disposed between and in contact with the annular spring and the valve retainer.

In some embodiments, the discharge valve includes a base seated against the end plate and a discharge reed seated against the base, the base includes a passage in communication with the discharge passage. The discharge reed is deflectable relative to the base between a first position in which a free end of the discharge reed sealingly covers the passage and a second position in which the free end uncovers the passage.

In some embodiments, the discharge valve includes a backer disposed between the hub and the discharge reed. The backer may define the second position of the discharge valve.

In some embodiments, the discharge valve assembly includes first and second non-threaded pins extending through the backer, a fixed end of the discharge reed and the base and engaging the end plate.

In some embodiments, the compressor includes an annular retainer threadably engaging the central opening of the hub and axially retaining the backer relative to the end plate.

In some embodiments, the compressor includes an annular seal assembly received in an annular recess defined between the hub and the end plate. The annular seal may cooperate with the hub to define a biasing chamber therebetween that contains pressurized fluid (e.g., intermediate-pressure fluid greater than suction pressure and less than discharge pressure) biasing the scroll member axially toward another scroll member.

In some embodiments, the end plate includes a first intermediate-pressure passage disposed radially outward relative to the discharge passage and in communication with the biasing chamber. The first intermediate-pressure passage may be disposed radially outward relative to the bypass passage.

In some embodiments, the hub includes a second intermediate-pressure passage providing fluid communication between the first intermediate-pressure passage and the biasing chamber.

In some embodiments, the scroll member is a non-orbiting scroll member.

In another form, the present disclosure provides a compressor that may include a scroll member, a hub, a discharge valve assembly, and first and second bypass assemblies. The scroll member includes an end plate and a wrap extending from the end plate. The end plate includes a recess, a discharge passage in communication with the recess, and first and second bypass passages in communication with the recess and disposed radially outward relative to the discharge passage. The hub may be received in the recess and may include a central opening in communication with the discharge passage and the first and second bypass passages. The discharge valve assembly may engage the hub and may be disposed between the hub and the end plate. The discharge valve assembly includes a discharge valve member movable between a first position restricting fluid flow through the discharge passage and a second position allowing fluid flow through the discharge passage. The first and second bypass valve assemblies may be disposed between the hub and the end plate and may include first and second bypass valve members movable between first positions restricting fluid flow through the first and second bypass passages and second positions allowing fluid flow through the first and second bypass passages.

In some embodiments, the first and second bypass valve assemblies include first and second valve retainers engaging the first and second bypass valve members and defining the second positions of the first and second bypass valve members.

In some embodiments, the discharge valve assembly includes a base seated against the end plate. The base may include an aperture in communication with the discharge passage. The discharge valve member may be deflectable relative to the base between the first position in which a free end of the discharge valve member sealingly covers the aperture and the second position in which the free end uncovers the aperture.

In some embodiments, the discharge valve assembly includes a backer disposed between the hub and the discharge valve member and defining the second position of the discharge valve member.

In some embodiments, the compressor includes an annular spring disposed between the hub and the first and second valve retainers and biasing the first and second valve retainers toward the end plate.

In some embodiments, the compressor includes first, second, third and fourth non-threaded pins. The first and second non-threaded pins may extend through the first valve retainer and a fixed end of the first bypass valve member. The third and fourth non-threaded pins may extend through the second valve retainer and a fixed end of the second bypass valve member. The first, second, third and fourth non-threaded pins may engage the end plate by a press fit, for example. Movable ends of the first and second bypass valve members may be deflectable relative to the fixed ends between the first and second positions.

In some embodiments, the compressor includes an annular spacer member disposed between and in contact with the annular spring and the first and second valve retainers.

In some embodiments, the discharge valve assembly includes fifth and sixth non-threaded pins extending through the backer, a fixed end of the discharge valve member and the base. The fifth and sixth non-threaded pins may engage the end plate by a press fit, for example.

In some embodiments, the compressor includes an annular retainer threadably engaging the central opening of the hub and axially retaining the backer relative to the end plate.

In some embodiments, the compressor includes an annular seal assembly received in an annular recess defined between the hub and the end plate. The annular seal may cooperate with the hub to define a biasing chamber therebetween that contains pressurized fluid (e.g., intermediate-pressure fluid greater than suction pressure and less than discharge pressure) biasing the scroll member axially toward another scroll member.

In some embodiments, the end plate includes a first intermediate-pressure passage disposed radially outward relative to the discharge passage and in communication with the biasing chamber. The first intermediate-pressure passage may be disposed radially outward relative to the bypass passage.

In some embodiments, the hub includes a second intermediate-pressure passage providing fluid communication between the first intermediate-pressure passage and the biasing chamber.

In some embodiments, the scroll member is a non-orbiting scroll member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
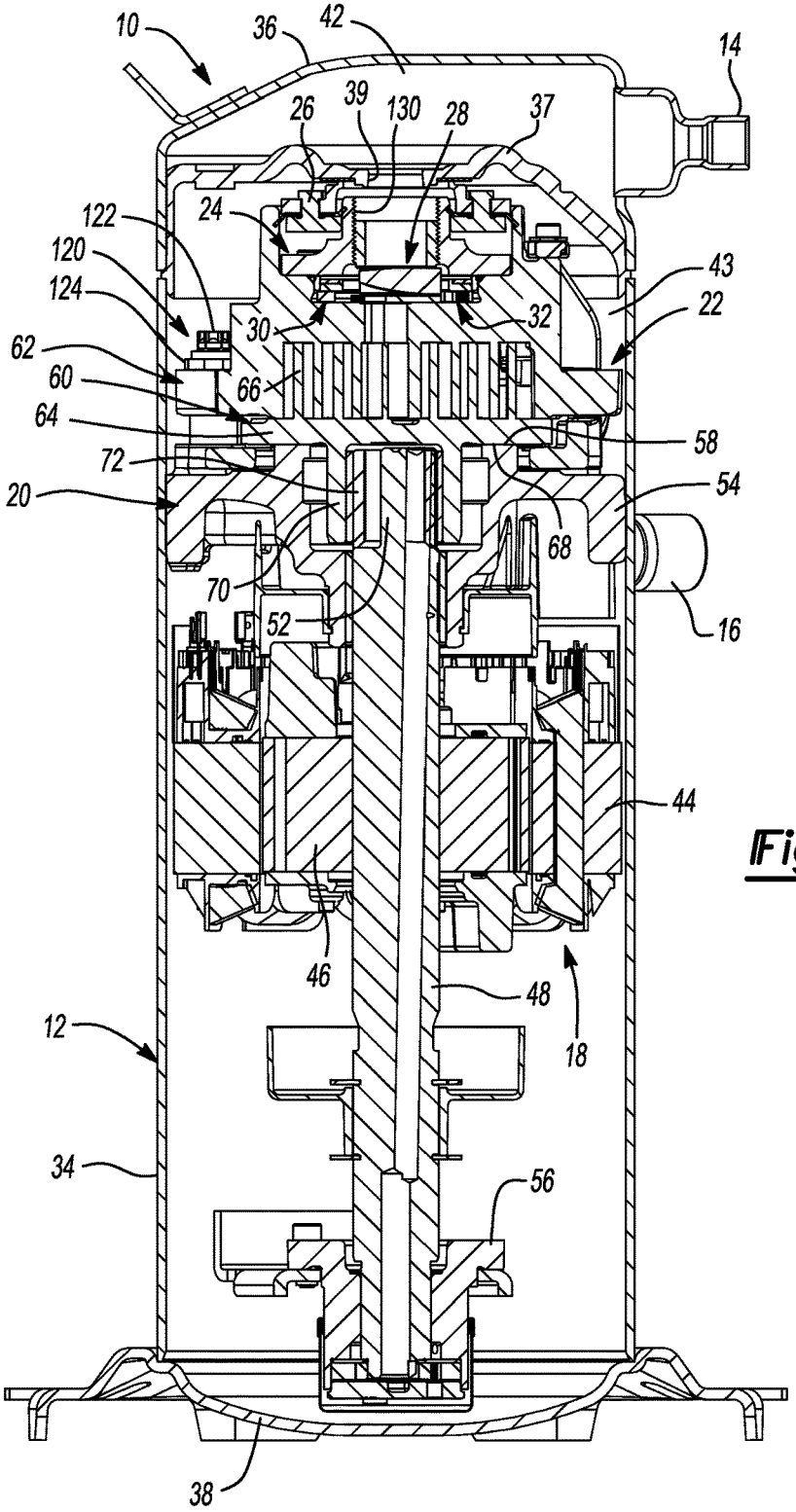
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a scroll compressor 10 is provided that may include a shell assembly 12, a discharge fitting 14, a suction inlet fitting 16, a motor assembly 18, a bearing housing assembly 20, a compression mechanism 22, a hub 24, a floating seal assembly 26, a primary discharge valve assembly 28 and first and second bypass (variable volume ratio) valve assemblies 30, 32.

The shell assembly 12 may house the motor assembly 18, the bearing housing assembly 20, the compression mechanism 22, the hub 24, the floating seal assembly 26, the primary discharge valve assembly 28 and the first and second bypass valve assemblies 30, 32. The shell assembly 12 may include a generally cylindrical shell 34, an end cap 36, a transversely extending partition 37, and a base 38. The end cap 36 may be fixed to an upper end of the shell 34. The base 38 may be fixed to a lower end of shell 34. The end cap 36 and partition 37 may define a discharge chamber 42 therebetween that receives compressed working fluid from the compression mechanism 22. The partition 37 may include an aperture 39 providing communication between the compression mechanism 22 and the discharge chamber 42. The discharge chamber 42 may generally form a discharge muffler for the compressor 10. The discharge fitting 14 may be attached to the end cap 36 and is in fluid communication with the discharge chamber 42. The suction inlet fitting 16 may be attached to the shell 34 and may be in fluid communication with a suction chamber 43. While the compressor 10 is shown in FIG. 1 as including the discharge chamber 42 and suction chamber 43, it will be appreciated that the present disclosure is not limited to compressors having discharge chambers and/or suction chambers and applies equally to direct discharge configurations and/or direct or directed suction configurations.

The motor assembly 18 may include a motor stator 44, a rotor 46, and a drive shaft 48. The stator 44 may be press fit into the shell 34. The drive shaft 48 may be rotatably driven by the rotor 46 and supported by the bearing housing assembly 20. The drive shaft 48 may include an eccentric crank pin 52 having a flat thereon for driving engagement with the compression mechanism 22. The rotor 46 may be press fit on the drive shaft 48. The bearing housing assembly 20 may include a main bearing housing 54 and a lower bearing housing 56 fixed within the shell 34. The main bearing housing 54 may include an annular flat thrust bearing surface 58 that supports the compression mechanism 22 thereon.

The compression mechanism 22 may be driven by the motor assembly 18 and may generally include an orbiting scroll 60 and a non-orbiting scroll 62. The orbiting scroll 60 may include an end plate 64 having a spiral vane or wrap 66 on the upper surface thereof and an annular flat thrust surface 68 on the lower surface. The thrust surface 68 may interface with an annular flat thrust bearing surface 58 on the main bearing housing 54. A cylindrical hub 70 may project downwardly from the thrust surface 68 and may have a drive bushing 72 disposed therein. The drive bushing 72 may include an inner bore in which the crank pin 52 is drivingly disposed. The crank pin 52 may drivingly engage a flat surface in a portion of the inner bore of the drive bushing 72 to provide a radially compliant driving arrangement.

Figure 2:
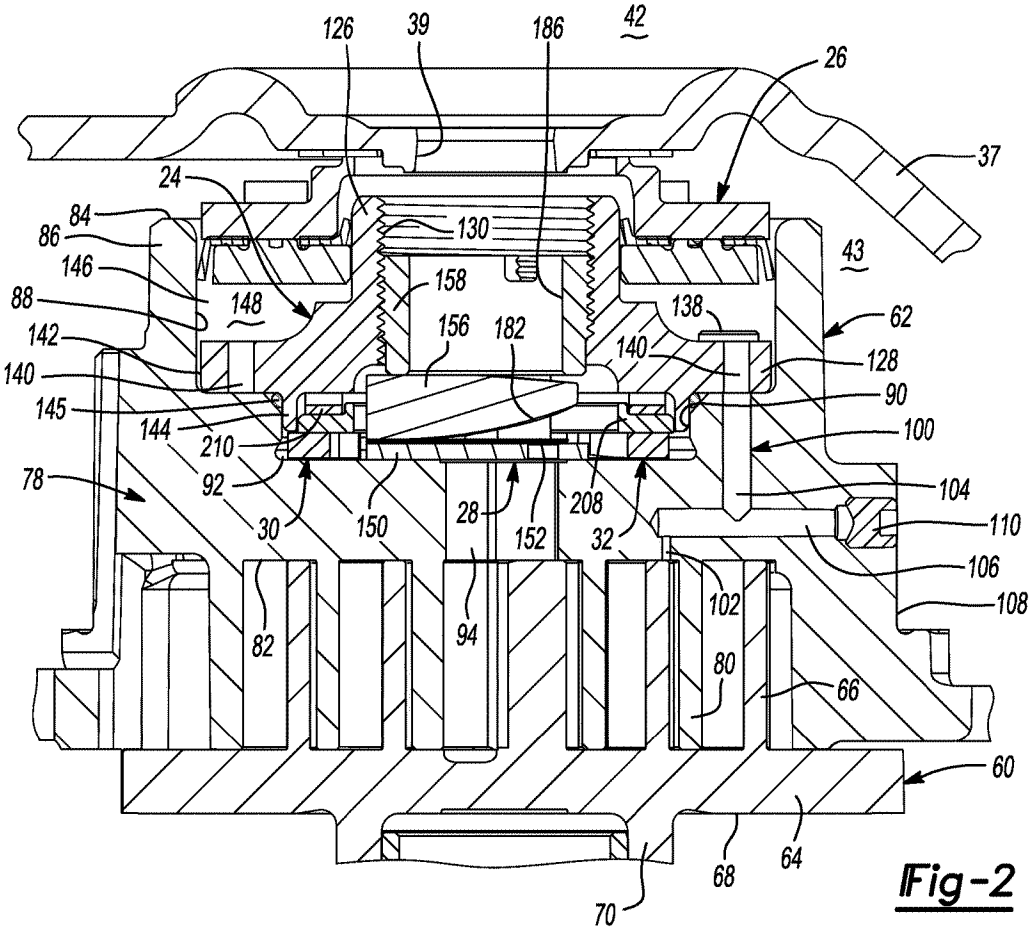
FIG. 2 is a partial cross-sectional view of a compression mechanism of the compressor of FIG. 1.
Figure 3:
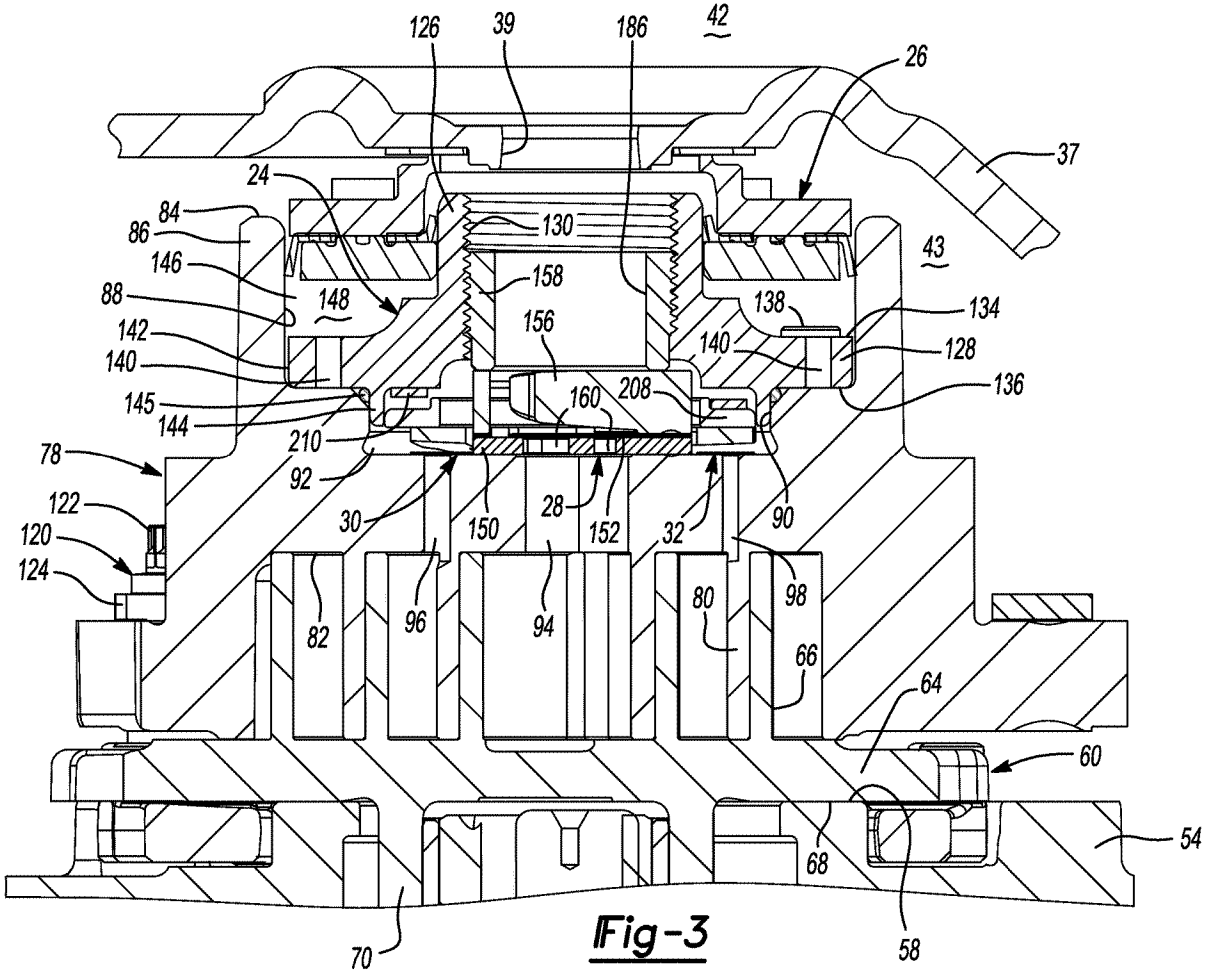
FIG. 3 is another partial cross-sectional view of the compression mechanism.
Figure 4:
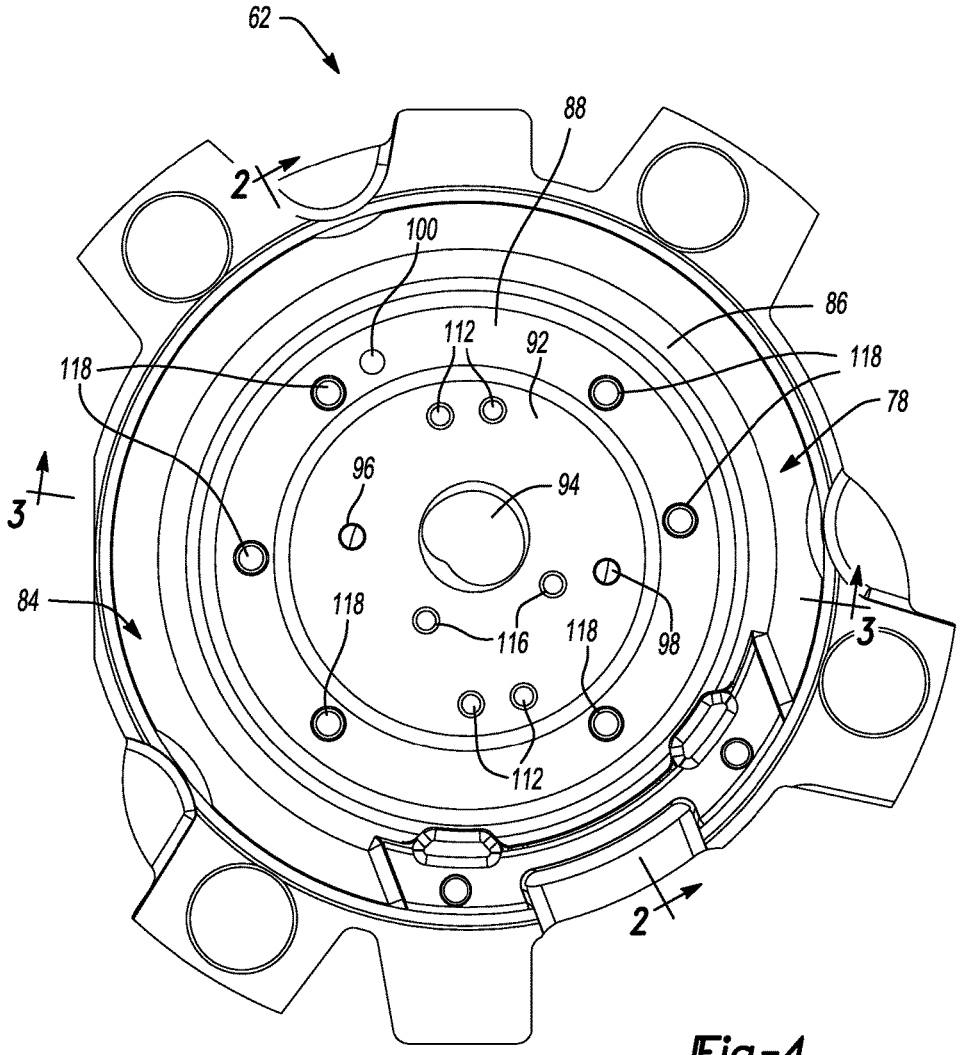
FIG. 4 is a plan view of a non-orbiting scroll of the compressor of FIG. 1.

As shown in FIGS. 2-4, the non-orbiting scroll 62 may include an end plate 78 and a spiral wrap 80 extending from a first side 82 of the end plate 78. A second side 84 of the end plate 78 may include a first annular wall 86 defining a first central recess 88. A second annular wall 90 may be disposed radially inward relative to the first annular wall 86 and may define a second central recess 92 extending axially (i.e., in a direction along or parallel to a rotational axis of the drive shaft 48) downward from the first central recess 88 toward the orbiting scroll 60. The first and second central recesses 88, 92 may cooperate to form a stepped recess. As shown in FIG. 3, a primary discharge passage 94 and first and second bypass passages 96, 98 may extend through the end plate 78 from the first side 82 to the second central recess 92. The first and second bypass passages 96, 98 are variable volume ratio passages disposed radially outward relative to the primary discharge passage 94.

As shown in FIGS. 2 and 4, a biasing passage 100 may extend through the end plate 78 from the first side 82 to the first central recess 88. As shown in FIG. 2, the biasing passage 100 may include first and second axially extending portions 102, 104 and a radially extending portion 106 extending between the first and second axially extending portions 102, 104. The second axially extending portion 104 may be disposed radially outward relative to the first and second bypass passages 96, 98. The first axially extending portion 102 may be disposed radially inward or outward relative to the bypass passages 96, 98 or the first axially extending portion 102 and the bypass passages 96, 98 may be radially equidistant from the primary discharge passage 94. The radially extending portion 106 may extend through a radially outer periphery 108 of the end plate 78 and may sealingly receive a plug 110.

As shown in FIG. 4, the end plate 78 may include two pairs of first pin bores 112, a pair of second pin bores 116 and a plurality of threaded holes 118. The pin bores 112, 116, are blind, non-threaded holes formed in the second central recess 92 that extend only partially through the end plate 78. The threaded holes 118 are blind holes formed in the first central recess 88 that extend only partially through the end plate 78.

The spiral wrap 80 of the non-orbiting scroll 62 may meshingly engage the spiral wrap 66 of the orbiting scroll 60, thereby creating a series of pockets therebetween. The pockets created by spiral wraps 66, 80 may decrease in volume throughout a compression cycle of the compression mechanism 22 and may include a suction-pressure pocket, intermediate-pressure pockets and a discharge-pressure pocket. The primary discharge passage 94 may be in communication with the discharge-pressure pocket, the first and second bypass passages 96, 98 may be in communication with respective intermediate-pressure pockets or the discharge-pressure pocket, and the biasing passage 100 may also be in communication with an intermediate-pressure pocket.

The non-orbiting scroll 62 may be rotationally secured to the main bearing housing 54 by a retaining assembly 120. The retaining assembly 120 allows for limited axial displacement of the non-orbiting scroll 62 relative to the orbiting scroll 60 and the main bearing housing 54 based on pressurized gas from biasing passage 100. The retaining assembly 120 may include a plurality of fasteners 122 and bushings 124 extending through the non-orbiting scroll 62. The fasteners 122 may fixedly engage the main bearing housing 54. The non-orbiting scroll 62 may be axially moveable along the bushings 124 relative to the fasteners 122.

Referring to FIGS. 2-7, the hub 24 may be a generally annular body including a central collar portion 126 and a flange portion 128. The central collar portion 126 may include a central opening 130 that extends axially through the hub 24 and forms a discharge passage in communication with the primary discharge passage 94, the bypass passages 96, 98 and the discharge chamber 42. At least a portion of the central opening 130 may be threaded.

The flange portion 128 extends radially outward from the collar portion 126. Mounting holes 132 may extend through first and second sides 134, 136 of the flange portion 128 and may be coaxially aligned with the threaded holes 118 in the non-orbiting scroll 62. Fasteners 138 (partially shown in FIGS. 2 and 3) extend through the mounting holes 132 and threadably engage the threaded holes 118 to fixedly secure the hub 24 relative to the non-orbiting scroll 62.

The flange portion 128 may also include one or more bleed holes 140 extending through the first and second sides 134, 136. In the particular embodiment shown in the figures, the flange portion 128 includes a plurality of bleed holes 140, one of which is aligned with the second axially extending portion 104 of the biasing passage 100 (shown in FIG. 2) and is in communication with an intermediate-pressure pocket via the biasing passage 100. The additional bleed holes 140 (i.e., the bleed holes 140 in addition to the bleed hole 140 aligned with the biasing passage 100) may be provided so that the hub 24 is compatible with different non-orbiting scrolls that may have intermediate passages located at different positions.

As shown in FIGS. 2 and 3, the hub 24 is received in the first central recess 88 of the non-orbiting scroll 62. In some embodiments, an outer periphery 142 of the flange portion 128 may sealingly engage the first annular wall 86 of the non-orbiting scroll 62. The flange portion 128 may include an annular rim 144 that extends axially downward from the second side 136 and is received in the second central recess 92 of the non-orbiting scroll 62. The annular rim 144 may sealingly engage the second annular wall 90 of the non-orbiting scroll 62. When the hub 24 is installed in the first central recess 88, the collar portion 126 of the hub 24 cooperates with the first annular wall 86 of the non-orbiting scroll 62 to form an annular recess 146. Additionally, a seal 145 (e.g., a gasket or O-ring) may sealingly engage the flange portion 128 and the annular rim 144 to fluidly isolate an annular biasing chamber 148 from the discharge chamber 42.

The floating seal assembly 26 may be disposed within the annular recess 146 and may sealingly engage the first annular wall 86, the collar portion 126 and the partition 37 to form the annular biasing chamber 148 that is isolated from the suction and discharge chambers 43, 42 of the compressor 10 and is in communication with the intermediate-pressure pocket via the bleed hole 140 and biasing passage 100. During operation of the compressor 10, the biasing chamber 148 may be filled with intermediate-pressure working fluid from the intermediate-pressure pocket, which biases the non-orbiting scroll 62 toward the orbiting scroll 60.

Figure 5:
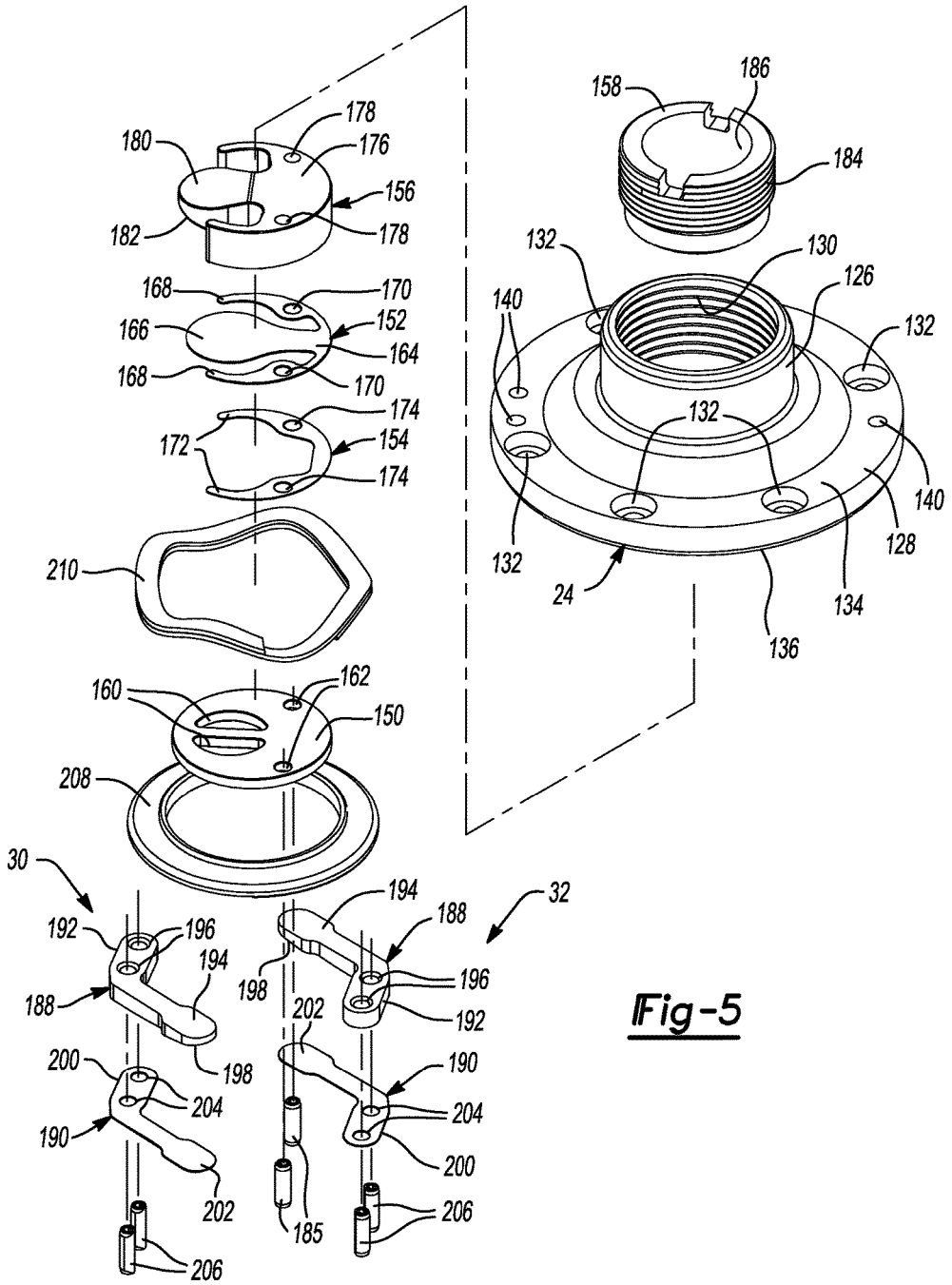
FIG. 5 is an exploded perspective view of a hub and valve assemblies according to the principles of the present disclosure.
Figure 6:
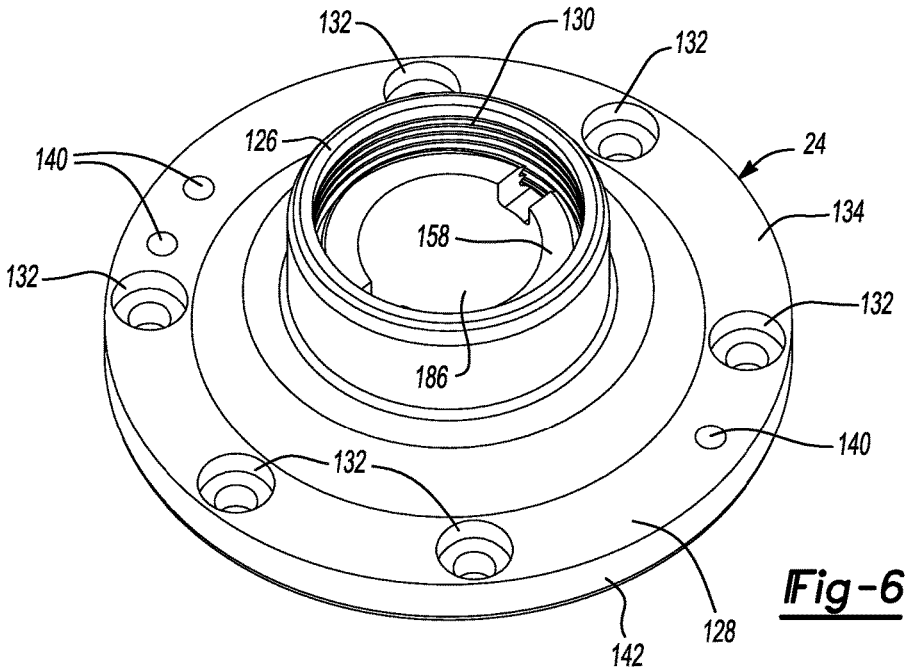
FIG. 6 is a perspective view of the hub.
Figure 7:
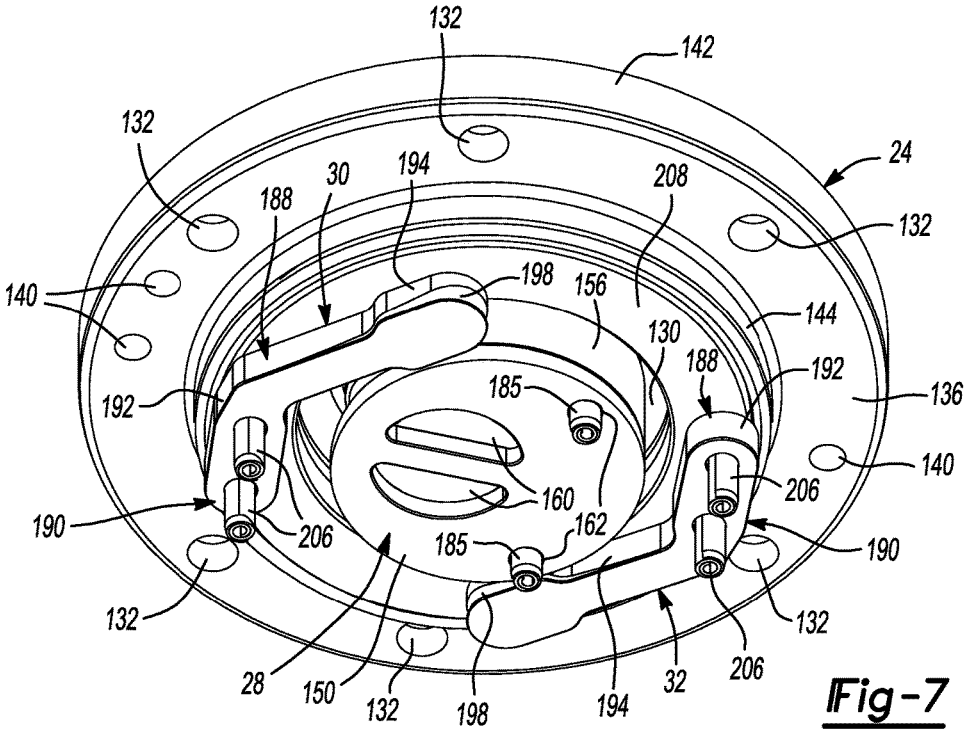
FIG. 7 is a perspective view of the hub and valve assemblies of FIG. 5.

The primary discharge valve assembly 28 may be received in the second central recess 92 between the hub 24 and the end plate 78 and may control fluid flow through the primary discharge passage 94. As shown in FIGS. 2, 3 and 5, the primary discharge valve assembly 28 may include a base 150, a reed valve member 152, a spacer 154, a backer 156, and a retainer 158. As shown in FIG. 5, the base 150 may be disk-shaped member having one or more discharge apertures 160 and a pair of pin bores 162 extending therethrough. The base 150 may be seated against the end plate 78 such that the discharge apertures 160 are aligned with the primary discharge passage 94. The pin bores 162 may be coaxially aligned with the pin bores 116 in the end plate 78.

As shown in FIG. 5, the reed valve member 152 may be a thin, resiliently flexible member having a fixed end 164 and a movable end 166. A pair of arms 168 may extend from the fixed end 164 and may each include a pin bore 170. The reed valve member 152 may be seated against the spacer 154, which in turn, may be seated against the base 150 such that the pin bores 170 are coaxially aligned with the pin bores 162 in the base 150. The movable end 166 of the reed valve member 152 is deflectable relative to the fixed end 164 between a closed position in which the movable end 166 sealingly seats against the base 150 to restrict or prevent fluid flow through the discharge apertures 160 (thereby preventing fluid flow through the primary discharge passage 94) and an open position in which the movable end 166 is deflected upward away from the base 150 and toward the backer 156 to allow fluid flow through the primary discharge passage 94 and the discharge apertures 160.

The spacer 154 may include a pair of arms 172 shaped to correspond to the arms 168 of the reed valve member 152. Each of the arms 172 may include a pin bore 174 coaxially aligned with corresponding ones of the pin bores 170, 162. The spacer 154 may be disposed between the base 150 and the reed valve member 152 to create a space between the movable end 166 and the discharge apertures 160. Discharge-pressure fluid in the discharge chamber 42 may force the movable end 166 against the discharge apertures 160 to restrict flow from the discharge chamber 42 to the primary discharge passage 94. The backer 156 may include a body 176 having a pair of pin bores 178 extending therethrough. The body 176 may include a lobe portion 180 shaped to correspond to the shape of the movable end 166 of the reed valve member 152. The lobe portion 180 may include an inclined surface 182 that faces the reed valve member 152 and forms a valve stop that defines a maximum amount of the deflection of the movable end 166 of the reed valve member 152. In some embodiments, the spacer 154 may be disposed between the reed valve member 152 and the base 150 so that the movable end 166 of the reed valve member 152 is normally in a slightly open position (i.e., slightly spaced apart from the base 150 when the movable end 166 is in an undeflected state).

Non-threaded mounting pins 185 may be press fit in the non-threaded pin bores 116, 162, 170, 174, 178 to secure the primary discharge valve assembly 28 to the end plate 78. In some embodiments, the pins 185 may be spiral pins having resiliently contractable diameters to facilitate insertion into the pin bores 116, 162, 170, 174, 178. The retainer 158 may be an annular member having external threads 184 and a central passage 186 extending therethrough. The retainer 158 may threadably engage the central opening 130 of the hub 24 and may be threadably tightened against the backer 156 to axially retain the primary discharge valve assembly 28 relative to the end plate 78.

The first and second bypass valve assemblies 30, 32 may be received in the second central recess 92 and may control fluid flow through the first and second bypass passages 96, 98, respectively. The first and second bypass valve assemblies 30, 32 may each include a valve retainer 188 and a reed valve member 190. The valve retainers 188 may include a base portion 192 and an arm portion 194 that extends at an angle from the base portion 192. The base portion 192 may include a pair of pin bores 196. A distal end of the arm portion 194 includes an inclined surface 198 that faces the reed valve member 190. The reed valve members 190 may be thin, resiliently flexible members shaped to correspond to the shape of the valve retainers 188. The reed valve members 190 may include a fixed end 200 and a movable end 202. The fixed end 200 may include a pair of pin bores 204 that are coaxially aligned with pin bores 196 in a corresponding valve retainer 188 and a corresponding pair of pin bores 112 in the non-orbiting scroll 62. Non-threaded mounting pins 206 may be press fit in the non-threaded pin bores 112, 196, 204 to secure the bypass valve assemblies 30, 32 to the end plate 78. In some embodiments, the pins 206 may be spiral pins having resiliently contractable diameters to facilitate insertion into the pin bores 112, 196, 204.

The movable ends 202 of the reed valve members 190 are deflectable relative to the fixed ends 200 between a closed position in which the movable ends 202 sealingly seat against the end plate 78 to restrict or prevent fluid flow through respective bypass passages 96, 98 and an open position in which the movable ends 202 are deflected upward away from the end plate 78 and toward the valve retainers 188 to allow fluid flow through the respective bypass passages 96, 98.

An annular spacer 208 and an annular biasing member 210 may be received in the second central recess 92 and may surround the primary discharge valve assembly 28. The annular spacer 208 may abut the valve retainers 188 of the bypass valve assemblies 30, 32. In some configurations, the annular spacer 208 may abut axial ends of the pins 206. The biasing member 210 may be disposed between the hub 24 and the annular spacer 208 and may bias the annular spacer 208 against the valve retainers 188 to axially secure the bypass valve assemblies 30, 32 relative to the end plate 78. The biasing member 210 can be a wave ring or a coil spring, for example. The biasing member 210 holds the bypass valve assemblies 30, 32 firmly against the end plate 78 and compensates for assembly tolerances. Furthermore, this configuration eliminates the need for threaded fasteners (which can loosen over time due to vibration during operation of the compressor 10) to secure the bypass valve assemblies 30, 32 to the end plate 78.

During operation of the compressor 10, working fluid in the pockets between the wraps 66, 80 of the orbiting and non-orbiting scrolls 60, 62 increase in pressure as the pockets move from a radially outer position (e.g., at suction pressure) toward a radially inner position (e.g., at discharge pressure). The bypass valve assemblies 30, 32 may be configured so that the reed valve members 190 will move into the open positions when exposed to pockets having working fluid at or above a predetermined pressure. The predetermined pressure can be selected to prevent the compressor 10 from over-compressing working fluid when the compressor 10 is operating under lighter load conditions, such as during operation in a cooling mode of a reversible heat-pump system. A system pressure ratio of a heat-pump system in the cooling mode may be lower than the system pressure ratio of the heat-pump system in a heating mode.

If, for example, the compressor 10 is operating in the lighter load cooling mode and working fluid is being compressed to a pressure equal to or greater than the predetermined pressure by the time the pockets containing the working fluid reaches the bypass passages 96, 98, the reed valve members 190 of the bypass valve assemblies 30, 32 will move into the open position to allow the working fluid to discharge through the bypass passages 96, 98. Working fluid discharged through the bypass passages 96, 98 may flow around the backer 156 of the primary discharge valve assembly 28, through the passage 186, through the central opening 130 of the hub 24 and into the discharge chamber 42. In this manner, the bypass passages 96, 98 may act as discharge passages when the reed valve members 190 are in the open positions.

If working fluid is not compressed to a level at least equal to the predetermined pressure by the time the pocket containing the working fluid reaches the bypass passages 96, 98, the reed valve members 190 of the bypass valve assemblies 30, 32 will stay closed, and the working fluid continue to be compressed until the pocket is exposed to the primary discharge passage 94. Thereafter, the working fluid will force the discharge reed valve member 152 into the open position and the working fluid will flow around the lobe portion 180 of the backer 156, through the central opening 130 and into the discharge chamber 42.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a scroll member including an end plate and a wrap extending from the end plate, the end plate including a recess, a discharge passage in fluid communication with the recess, and a bypass passage in fluid communication with the recess and disposed radially outward relative to the discharge passage;

a hub received in the recess and including a central opening in fluid communication with the discharge passage and the bypass passage;

a discharge valve disposed between the hub and the end plate and controlling fluid flow through the discharge passage; and a bypass valve disposed between the hub and the end plate and movable between a first position restricting fluid flow through the bypass passage and a second position allowing fluid to flow through the bypass passage, around the discharge valve and through the central opening, wherein the bypass valve is disposed within the recess such that the bypass passage is open to the recess when the bypass valve is in the second position, and wherein the bypass valve includes a valve retainer engaging a reed valve member and defining the second position of the bypass valve.

2. The compressor of claim 1, further comprising an annular spring disposed between the hub and the valve retainer and biasing the valve retainer toward the end plate.

3. The compressor of claim 2, further comprising first and second non-threaded pins extending through the valve retainer and a fixed end of the reed valve member and engaging the end plate, wherein a movable end of the reed valve member is deflectable relative to the fixed end between the first and second positions.

4. The compressor of claim 3, further comprising an annular spacer member disposed between and in contact with the annular spring and the valve retainer.

5. The compressor of claim 1, wherein the discharge valve includes a base seated against the end plate and a discharge reed seated against the base, the base includes a passage in fluid communication with the discharge passage, wherein the discharge reed is deflectable relative to the base between a first position in which a free end of the discharge reed sealingly covers the passage and a second position in which the free end uncovers the passage.

6. The compressor of claim 5, wherein the discharge valve includes a backer disposed between the hub and the discharge reed and defining the second position of the discharge valve.

7. The compressor of claim 6, wherein the discharge valve includes first and second non-threaded pins extending through the backer, a fixed end of the discharge reed and the base and engaging the end plate.

8. The compressor of claim 7, further comprising an annular retainer threadably engaging the central opening of the hub and axially retaining the backer relative to the end plate.

9. The compressor of claim 1, further comprising an annular seal assembly received in an annular recess defined between the hub and the end plate, the annular seal cooperating with the hub to define a biasing chamber therebetween that contains pressurized fluid biasing the scroll member axially toward another scroll member.

10. The compressor of claim 9, wherein the end plate includes a first intermediate-pressure passage disposed radially outward relative to the discharge passage and in fluid communication with the biasing chamber.

11. The compressor of claim 10, wherein the hub includes a second intermediate-pressure passage providing fluid communication between the first intermediate-pressure passage and the biasing chamber.

12. The compressor of claim 1, wherein the scroll member is a non-orbiting scroll member.

13. The compressor of claim 1, further comprising an annular spring disposed between the hub and a valve retainer and biasing the valve retainer toward the end plate.

14. A compressor comprising:

a scroll member including an end plate and a wrap extending from the end plate, the end plate including a recess, a discharge passage in fluid communication with the recess, and first and second bypass passages in fluid communication with the recess and disposed radially outward relative to the discharge passage;

a hub received in the recess and including a central opening in fluid communication with the discharge passage and the first and second bypass passages;

a discharge valve assembly engaging the hub and disposed between the hub and the end plate, the discharge valve assembly including a discharge valve member movable between a first position restricting fluid flow through the discharge passage and a second position allowing fluid flow through the discharge passage; and first and second bypass valve assemblies disposed between the hub and the end plate and including first and second bypass valve members movable between first positions restricting fluid flow through the first and second bypass passages and second positions allowing fluid flow through the first and second bypass passages.

15. The compressor of claim 14, wherein the first and second bypass valve assemblies include first and second valve retainers engaging the first and second bypass valve members and defining the second positions of the first and second bypass valve members.

16. The compressor of claim 15, wherein the discharge valve assembly includes a base seated against the end plate, the base includes an aperture in fluid communication with the discharge passage, wherein the discharge valve member is deflectable relative to the base between the first position in which a free end of the discharge valve member sealingly covers the aperture and the second position in which the free end uncovers the aperture.

17. The compressor of claim 16, wherein the discharge valve assembly includes a backer disposed between the hub and the discharge valve member and defining the second position of the discharge valve member.

18. The compressor of claim 17, further comprising an annular spring disposed between the hub and the first and second valve retainers and biasing the first and second valve retainers toward the end plate.

19. The compressor of claim 18, further comprising:

first and second non-threaded pins extending through the first valve retainer and a fixed end of the first bypass valve member and engaging the end plate; and third and fourth non-threaded pins extending through the second valve retainer and a fixed end of the second bypass valve member and engaging the end plate, wherein movable ends of the first and second bypass valve members are deflectable relative to the fixed ends between the first and second positions.

20. The compressor of claim 19, further comprising an annular spacer member disposed between and in contact with the annular spring and the first and second valve retainers.

21. The compressor of claim 20, wherein the discharge valve assembly includes fifth and sixth non-threaded pins extending through the backer, a fixed end of the discharge valve member and the base and engaging the end plate.

22. The compressor of claim 21, further comprising an annular retainer threadably engaging the central opening of the hub and axially retaining the backer relative to the end plate.

23. The compressor of claim 22, further comprising an annular seal assembly received in an annular recess defined between the hub and the end plate, the annular seal cooperating with the hub to define a biasing chamber therebetween that contains pressurized fluid biasing the scroll member axially toward another scroll member.

24. The compressor of claim 23, wherein the end plate includes a first intermediate-pressure passage disposed radially outward relative to the discharge passage and in fluid communication with the biasing chamber.

25. The compressor of claim 24, wherein the hub includes a second intermediate-pressure passage providing fluid communication between the first intermediate-pressure passage and the biasing chamber.

26. A compressor comprising:

a scroll member including an end plate and a wrap extending from the end plate, the end plate including a recess, a discharge passage in fluid communication with the recess, and a bypass passage in fluid communication with the recess and disposed radially outward relative to the discharge passage;

a hub received in the recess and including a central opening in fluid communication with the discharge passage and the bypass passage;

a discharge valve disposed between the hub and the end plate and controlling fluid flow through the discharge passage; and a bypass valve disposed between the hub and the end plate and movable between a first position restricting fluid flow through the bypass passage and a second position allowing fluid to flow through the bypass passage, around the discharge valve and through the central opening, wherein the bypass valve is disposed within the recess such that the bypass passage is open to the recess when the bypass valve is in the second position, and wherein the discharge valve includes a base seated against the end plate and a discharge reed seated against the base, the base includes a passage in fluid communication with the discharge passage, wherein the discharge reed is deflectable relative to the base between a first position in which a free end of the discharge reed sealingly covers the passage and a second position in which the free end uncovers the passage.

27. The compressor of claim 26, wherein the discharge valve includes a backer disposed between the hub and the discharge reed and defining the second position of the discharge valve, and wherein the discharge valve includes first and second non-threaded pins extending through the backer, a fixed end of the discharge reed and the base and engaging the end plate.

28. The compressor of claim 27, further comprising an annular retainer threadably engaging the central opening of the hub and axially retaining the backer relative to the end plate.

29. The compressor of claim 26, wherein the bypass valve includes a valve retainer engaging a reed valve member and defining the second position of the bypass valve, and wherein the compressor further comprises an annular spring disposed between the hub and the valve retainer and biasing the valve retainer toward the end plate.

* * * * *